US009709076B2

(12) United States Patent
Akiyama et al.

(10) Patent No.: US 9,709,076 B2
(45) Date of Patent: Jul. 18, 2017

(54) HYDRAULIC DRIVE SYSTEM

(75) Inventors: Teruo Akiyama, Kokubunji (JP); Noboru Iida, Chigasaki (JP); Kenji Oshima, Koto-ku (JP); Kenji Sasano, Hiratsuka (JP)

(73) Assignee: KOMATSU LTD., Tokyo (JP)

( * ) Notice: Subject to any disclaimer, the term of this patent is extended or adjusted under 35 U.S.C. 154(b) by 351 days.

(21) Appl. No.: 14/356,705

(22) PCT Filed: Sep. 11, 2012

(86) PCT No.: PCT/JP2012/073119

§ 371 (c)(1),
(2), (4) Date: Aug. 11, 2014

(87) PCT Pub. No.: WO2013/128690

PCT Pub. Date: Sep. 6, 2013

(65) Prior Publication Data

US 2014/0345265 A1 Nov. 27, 2014

(30) Foreign Application Priority Data

Feb. 27, 2012 (JP) ..... 2012-039787

(51) Int. Cl.

| | |
|---|---|
| ***F16D 31/02*** | (2006.01) |
| ***F15B 1/04*** | (2006.01) |
| ***E02F 9/22*** | (2006.01) |
| ***F15B 11/17*** | (2006.01) |

(52) U.S. Cl.

CPC ..... *F15B 1/04* (2013.01); *E02F 9/2217* (2013.01); *E02F 9/2235* (2013.01);
(Continued)

(58) Field of Classification Search

CPC ..... E02F 9/2292; E02F 9/2217
(Continued)

(56) References Cited

U.S. PATENT DOCUMENTS

H001977 H * 8/2001 Poorman ..... 60/445
8,033,107 B2 10/2011 Tikkanen
(Continued)

FOREIGN PATENT DOCUMENTS

JP 6-6706 U 1/1994
JP 2695001 B2 9/1997
(Continued)

OTHER PUBLICATIONS

Machine Translation of Abstract JP 11-351007.*
(Continued)

*Primary Examiner* — Thomas E Lazo
*Assistant Examiner* — Daniel Collins
(74) *Attorney, Agent, or Firm* — Global IP Counselors, LLP

(57) ABSTRACT

An operating state determining unit determines whether a hydraulic cylinder is in operation or not in operation. A discharge pressure reducing unit reduces the discharge pressure of a charge pump. A discharge pressure control unit controls the discharge pressure reducing unit when the hydraulic cylinder in not in operation to reduce the discharge pressure of the charge pump to a low pressure lower than a normal pressure. The normal pressure is the discharge pressure of the charge pump when the hydraulic cylinder is in operation. An accumulator is connected to a charge flowpath. A one-way valve is disposed between the accumulator and the charge pump. The one-way valve allows the flow of hydraulic fluid from the charge pump to the accumulator and prohibits the flow of hydraulic fluid from the accumulator to the charge pump.

8 Claims, 6 Drawing Sheets

(52) U.S. Cl.
CPC ..... *E02F 9/2285* (2013.01); *E02F 9/2289* (2013.01); *E02F 9/2292* (2013.01); *E02F 9/2296* (2013.01); *F15B 11/17* (2013.01); *F15B 2211/20546* (2013.01); *F15B 2211/20561* (2013.01); *F15B 2211/20576* (2013.01); *F15B 2211/275* (2013.01); *F15B 2211/30525* (2013.01); *F15B 2211/327* (2013.01); *F15B 2211/613* (2013.01); *F15B 2211/625* (2013.01); *F15B 2211/633* (2013.01); *F15B 2211/6306* (2013.01); *F15B 2211/6346* (2013.01); *F15B 2211/7053* (2013.01)

(58) Field of Classification Search
USPC ..... 60/418
See application file for complete search history.

(56) References Cited

U.S. PATENT DOCUMENTS

| | | | | |
|---|---|---|---|---|
| 2003/0097837 | A1 | 5/2003 | Hiraki et al. | |
| 2005/0196288 | A1 | 9/2005 | Cherney | |
| 2011/0030364 | A1 | 2/2011 | Persson et al. | |
| 2013/0098020 | A1* | 4/2013 | Opdenbosch | F15B 7/006 60/327 |

FOREIGN PATENT DOCUMENTS

| | | | |
|---|---|---|---|
| JP | 2569841 | Y2 | 2/1998 |
| JP | 2973478 | B2 | 9/1999 |
| JP | 11-351007 | A | 12/1999 |
| JP | 2005-249198 | A | 9/2005 |
| JP | 3862256 | B2 | 12/2006 |
| JP | 2009-511831 | A | 3/2009 |
| JP | 2009-79775 | A | 4/2009 |
| JP | 2012-15272 | A | 1/2012 |

OTHER PUBLICATIONS

The Office Action for the corresponding German application No. 11 2012 005 015.0 dated Jul. 21, 2016.
An Office Action for the corresponding Japanese patent application No. 2012-039787, issued on Oct. 13, 2015.
The International Search Report for the corresponding international application No. PCT/JP2012/073119, issued on Dec. 18, 2012.

* cited by examiner

HYDRAULIC DRIVE SYSTEM

CROSS-REFERENCE TO RELATED APPLICATIONS

This application is a U.S. National stage application of International Application No. PCT/JP2012/073119, filed on Sep. 11, 2012. This U.S. National stage application claims priority under 35 U.S.C. §119(a) to Japanese Patent Application No. 2012-039787, filed in Japan on Feb. 27, 2012, the entire contents of which are hereby incorporated herein by reference.

BACKGROUND

Field of the Invention

The present invention relates to a hydraulic drive system.

Background Information

Work machines, such as a hydraulic excavator or a wheel loader, are equipped with a hydraulic cylinder. Hydraulic fluid discharged from a hydraulic pump is supplied to the hydraulic cylinder through a hydraulic circuit. For example, Japanese National Publication of International Patent Application No. 2009-511831 describes a work machine equipped with a hydraulic closed circuit for supplying hydraulic fluid to the hydraulic cylinders. Kinetic energy and potential energy of the members driven by the hydraulic cylinder are regenerated due to the hydraulic circuit being a closed circuit. As a result, fuel consumption of a driving source for driving the hydraulic pump may be reduced.

A charge circuit is often installed in the closed hydraulic circuit. The charge circuit is provided for replenishing an amount of hydraulic fluid corresponding to oil leakage from the hydraulic pump. A charge pump and a relief valve are provided in the charge circuit. The charge pump is normally a fixed displacement pump and is driven by a driving source, such as an engine. The relief valve regulates the hydraulic pressure (referred to below as "charge pressure") in the charge circuit. When the flow rate of the hydraulic fluid supplied to the hydraulic pump is insufficient, the hydraulic pressure in the hydraulic closed circuit falls below the charge pressure and hydraulic fluid is supplied from the charge circuit to the hydraulic closed circuit.

SUMMARY

The hydraulic closed circuit described above is desirably provided in a hydraulic circuit for which the sufficient regeneration of kinetic energy and potential energy is expected. As a result, the hydraulic closed circuit is often provided independently of a normal hydraulic circuit. For example, in the case of a hydraulic excavator, a boom cylinder is driven by the hydraulic closed circuit. Alternatively, in the case of a wheel loader, a lift cylinder is driven by the hydraulic closed circuit. In these cases, the hydraulic closed circuit is not operated when the vehicle is traveling. As a result, power consumption in the charge pump is mostly lost.

The use of a variable displacement pump as the charge pump may be considered to reduce the loss of power consumption in the abovementioned charge pump. In this case, loss of power consumption in the charge pump may be reduced by changing the discharge flow rate of the charge pump to zero when the hydraulic closed circuit is not operating. However, variable displacement pumps are more expensive than fixed displacement pumps. As a result, there is a problem in that the cost of a work machine increases when a variable displacement pump is used for the charge pump.

Moreover, a check valve is provided in the abovementioned hydraulic closed circuit to prohibit a reverse flow of the hydraulic fluid. The check valve is disposed between a hydraulic pump and a hydraulic cylinder in the hydraulic closed circuit. For example, the check valve is disposed between the hydraulic pump and the boom cylinder in the hydraulic closed circuit when the hydraulic cylinder is a boom cylinder in a hydraulic excavator. Because a superimposed load of the bucket or the load from the deadweight of the working implement acts on the boom cylinder, hydraulic pressure for supporting such a load (referred to below as "holding pressure") is produced in a flowpath between the boom cylinder and the check valve. When hydraulic fluid is supplied to the boom cylinder in this state, the hydraulic fluid discharged from the hydraulic pump is used first to raise the hydraulic pressure between the hydraulic pump and the check valve to the holding pressure. Then, when the hydraulic pressure in the flowpath between the hydraulic pump and the check valve equals or exceeds the holding pressure, the check valve is opened and the hydraulic fluid is supplied to the boom cylinder. Consequently, the operation of the boom cylinder starts. Because there is no return oil from the boom cylinder to the hydraulic pump before the operation of the boom cylinder starts, all of the hydraulic fluid supplied to the hydraulic pump is supplied from the charge circuit. Therefore, the charge pump requires only enough capacity to be able to supply a flow rate of the hydraulic fluid when raising the pressure in this way. Conversely, the existing hydraulic pressure between the hydraulic pump and the boom cylinder while the boom cylinder is in operation reaches the required pressure to drive the boom cylinder. As a result, the charge pump may be able to supply the hydraulic fluid at a flow rate that is less than the abovementioned flow rate when raising the pressure. Therefore, when the capacity of the charge pump is set on the basis of when the pressure is raised as described above, hydraulic fluid at an excessive flow rate is produced during the operation of the boom cylinder. The hydraulic fluid at the excessive flow rate is exhausted from the charge flowpath to a hydraulic fluid tank. In this way, when the capacity of the charge pump is set on the basis of when the pressure is raised as described above, hydraulic fluid at a high flow rate is wastefully exhausted from the charge flowpath. Further, if the capacity of the charge pump is high, the loss of power consumption in the charge pump in the abovementioned state when the hydraulic closed circuit is not in operation also increases.

An aspect of the present invention is to provide a hydraulic drive system that reduces power consumption loss in the charge pump.

The hydraulic drive system according to a first aspect of the present invention is provided with a main pump, a hydraulic cylinder, a hydraulic fluid flowpath, a check valve, a charge circuit, an operating member, an operating state determining unit, a discharge pressure reducing unit, a discharge pressure control unit, an accumulator, and a one-way valve. The main pump has a first hydraulic pump and a second hydraulic pump that discharge hydraulic fluid. The hydraulic cylinder is driven by hydraulic fluid discharged from the main pump. The hydraulic fluid flowpath connects the first hydraulic pump and the second hydraulic pump to the hydraulic cylinder. The hydraulic fluid flowpath configures a closed circuit between the first hydraulic pump and the hydraulic cylinder. The check valve is disposed between the main pump and the hydraulic cylinder in the hydraulic fluid flowpath. The check valve allows the flow of hydraulic fluid from the main pump to the hydraulic cylinder and prohibits the flow of hydraulic fluid from the hydraulic cylinder to the main pump. The charge circuit has a charge flowpath and a charge pump. The charge flowpath is connected between the main pump and the check valve in the hydraulic fluid flowpath. The charge pump discharges hydraulic fluid into the charge flowpath. The charge circuit replenishes the hydraulic fluid flowpath with hydraulic fluid when the hydraulic pressure in the hydraulic fluid flowpath is lower than the charge pressure. The operating member is a member for operating the hydraulic cylinder. The operating state determining unit determines whether the hydraulic cylinder is in operation or not in operation. A discharge pressure reducing unit reduces the discharge pressure of a charge pump. A discharge pressure control unit controls the discharge pressure reducing unit while the hydraulic cylinder in not in operation to reduce the discharge pressure of the charge pump to a low pressure lower than a normal pressure. The normal pressure is the discharge pressure of the charge pump when the hydraulic cylinder is in operation. An accumulator is connected to a charge flowpath. A one-way valve is disposed between the accumulator and the charge pump. The one-way valve allows the flow of hydraulic fluid from the charge pump to the accumulator and prohibits the flow of hydraulic fluid from the accumulator to the charge pump.

The hydraulic drive system according to a second aspect of the present invention is related to the hydraulic drive system of the first aspect, and further includes an accumulated pressure detecting unit and an accumulated pressure determining unit. The accumulated pressure detecting unit detects an accumulated pressure of the accumulator. The accumulated pressure determining unit determines whether the accumulated pressure of the accumulator is equal to or less than a first setting pressure. The discharge pressure control unit changes the discharge pressure of the charge pump from the low pressure to the normal pressure when the accumulated pressure of the accumulator is equal to or less than the first setting pressure while the hydraulic cylinder is not in operation.

The hydraulic drive system according to a third aspect of the present invention is related to the hydraulic drive system of the second aspect, wherein the accumulated pressure determining unit determines whether the accumulated pressure of the accumulator is equal to or greater than a second setting pressure. The second setting pressure is higher than the first setting pressure. The discharge pressure control unit returns the discharge pressure of the charge pump to the normal pressure from the normal pressure when the accumulated pressure of the accumulator recovers from a pressure equal to or less than the first setting pressure to a pressure equal to or greater than the second setting pressure while the hydraulic cylinder is not in operation.

The hydraulic drive system according to a fourth aspect of the present invention is related to the hydraulic drive system of the second or third aspect, and further includes a pump control unit. The pump control unit controls the discharge flow rate of the main pump on the basis of an operating position of the operating member. The operating state determining unit determines whether the hydraulic cylinder is in operation or not in operation on the basis of the operating position of the operating member. The accumulated pressure determining unit determines whether the accumulated pressure of the accumulator is equal to or less than a third setting pressure. The pump control unit conducts a standby control even if an operation to start the discharge of hydraulic fluid from the main pump is conducted by the operating member when the accumulated pressure of the accumulator is equal to or less than the third setting pressure. The standby control is a control for not allowing the start of the discharge of hydraulic fluid from the main pump until the accumulated pressure of the accumulator is greater than the third setting pressure.

The hydraulic drive system according to a fifth aspect of the present invention is related to the fourth aspect, wherein the third setting pressure is a pressure that is equal to or greater than the first setting pressure.

A hydraulic drive system according to a sixth aspect of the present invention is related to the hydraulic drive system of the fourth or fifth aspect, and further includes a display device that displays the fact that the standby control is being executed.

A hydraulic drive system according to a seventh aspect of the present invention is related to any one of the hydraulic drive system of the first to sixth aspects, wherein the operating state determining unit determines that the hydraulic cylinder is not in operation when the operating member is being held in a neutral position for a time period equal to or greater than a certain time period.

The hydraulic drive system according to an eighth aspect of the present invention is related to any one of the first to seventh aspects, wherein the charge flowpath has a first charge flowpath and a second charge flowpath. The first charge flowpath is connected to the charge pump. The second charge flowpath is connected to the first charge flowpath via the one-way valve. The discharge pressure reducing unit reduces the hydraulic pressure in the first charge flowpath.

The discharge pressure of the charge pump is reduced to the low pressure when the hydraulic cylinder is not in operation in the hydraulic drive system according to the first aspect of the present invention. As a result, power consumption loss in the charge pump may be reduced. Further, the replenishment of the hydraulic fluid flowpath with hydraulic fluid is made possible with hydraulic fluid discharged from the charge pump and hydraulic fluid stored in the accumulator when the pressure in the hydraulic fluid flowpath between the main pump and the check valve is raised up to the holding pressure. As a result, the charge pump may be made smaller in comparison to when the hydraulic fluid flowpath is replenished with hydraulic fluid only from the charge pump. As a result, power consumption loss in the charge pump may be further reduced. The flow of hydraulic fluid stored in the accumulator to the charge pump is prohibited when the charge pump is stopped due to the one-way valve. As a result, a reduction in the accumulated pressure of the accumulator may be suppressed.

Conversely, hydraulic fluid stored in the accumulator leaks gradually from sliding parts of the first hydraulic pump even if the hydraulic cylinder is not in operation. As a result, when the discharge pressure of the charge pump is maintained at the low pressure for a long period of time, the accumulated pressure of the accumulator falls due to the reduction of the hydraulic fluid stored in the accumulator over a period of time. In this state, there is a concern that aeration or cavitation may occur in the first hydraulic pump due to the shortage of hydraulic fluid to replenish the hydraulic fluid flowpath from the charge circuit when the hydraulic cylinder is in operation. Accordingly, the discharge pressure control unit changes the discharge pressure of the charge pump from the low pressure to the normal pressure when the accumulated pressure of the accumulator is equal to or less than the first setting pressure while the hydraulic cylinder is not in operation in the hydraulic drive system according to the second aspect of the present invention. As a result, a reduction in the accumulated pressure of the accumulator may be suppressed even when the hydraulic cylinder is maintained in a non-operating state for a long period of time. Specifically, the occurrence of aeration or of cavitation in the first hydraulic pump may be suppressed when operation of the hydraulic cylinder is started.

The discharge pressure of the charge pump is returned from the normal pressure to the low pressure when the accumulated pressure of the accumulator recovers to be equal to or greater than the second setting pressure in the hydraulic drive system according to the third aspect of the present invention. As a result, a reduction in the accumulated pressure of the accumulator is suppressed and power consumption loss in the charge pump may be reduced.

The discharge of hydraulic fluid from the main pump is not started until the accumulated pressure of the accumulator exceeds the third setting pressure even if the operating member is operated in the hydraulic drive system according to the fourth aspect of the present invention. As a result, the occurrence of aeration or of cavitation in the first hydraulic pump may be suppressed.

The discharge of hydraulic fluid from the main pump may be started in a state in which a required amount of hydraulic fluid is stored in the accumulator in the hydraulic drive system according to the fifth aspect of the present invention.

An operator may be notified that the main pump will not start due to the execution of the standby control in the hydraulic drive system according to the sixth aspect of the present invention.

The mistaken determination that the hydraulic cylinder is not in operation when the hydraulic cylinder is actually in operation, such as when the operating member temporarily passes through the neutral position, may be prevented in the hydraulic drive system according to the seventh aspect of the present invention.

The discharge pressure reducing unit reduces the pressure in the first charge flowpath in the hydraulic drive system according to the eighth aspect of the present invention. As a result, the discharge pressure of the charge pump is reduced.

DESCRIPTION OF EXEMPLARY EMBODIMENTS

A hydraulic drive system according to an exemplary embodiment of the present invention is explained hereinbelow with reference to the drawings.

First Exemplary Embodiment

Figure 1:
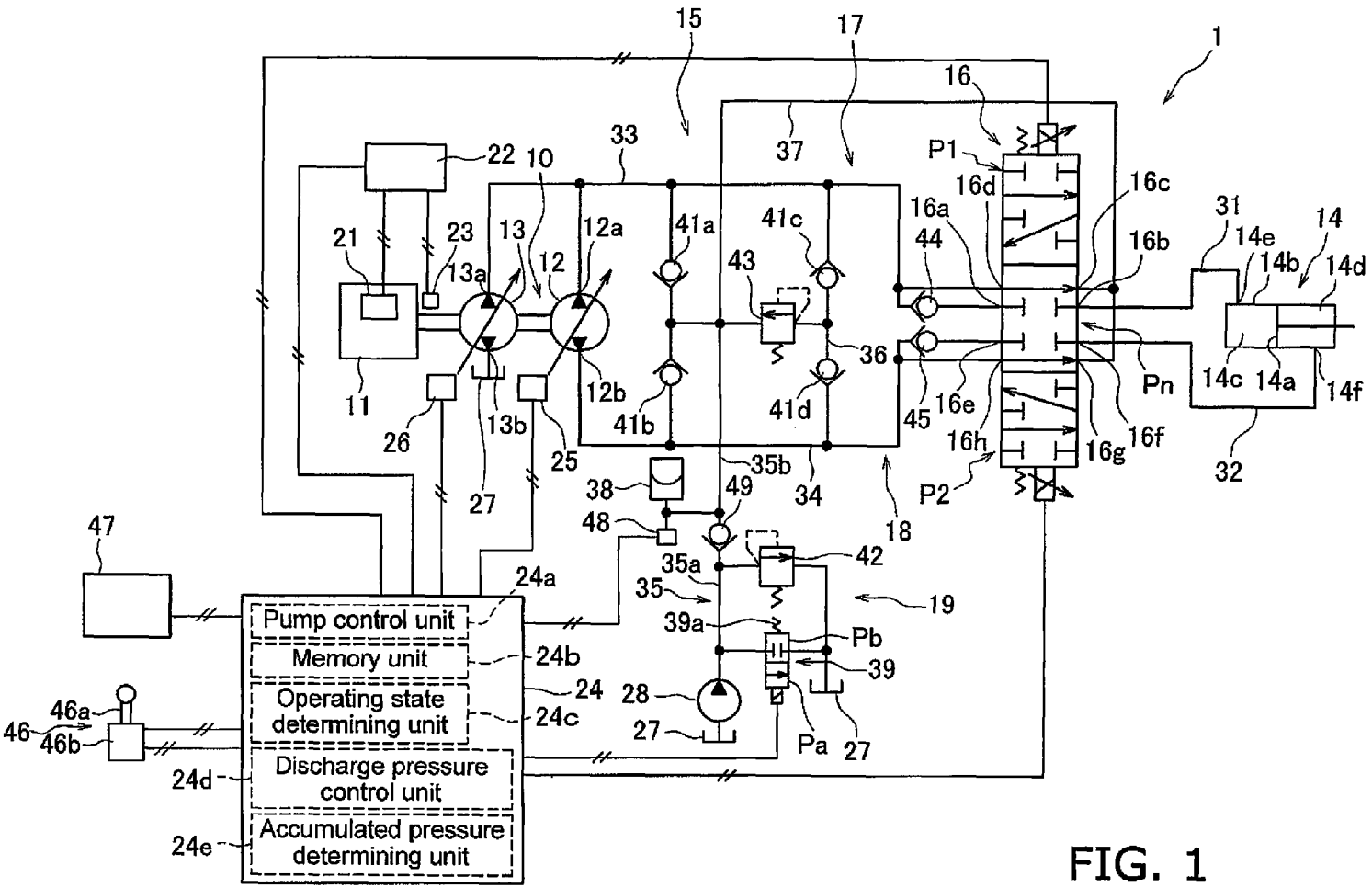
FIG. 1 is a block diagram of a configuration of a hydraulic drive system according to a first exemplary embodiment of the present invention.

FIG. 1 is a block diagram of a configuration of a hydraulic drive system 1 according to a first exemplary embodiment of the present invention. The hydraulic drive system 1 is installed on a work machine, such as a hydraulic excavator, a wheel loader, or a bulldozer. The hydraulic drive system 1 includes an engine 11, a main pump 10, a hydraulic cylinder 14, a hydraulic fluid flowpath 15, a flowpath switching valve 16, an engine controller 22, and a pump controller 24.

The engine 11 drives the main pump 10. The engine 11 is a diesel engine, for example, and the output of the engine 11 is controlled by adjusting an injection amount of fuel from a fuel injection pump 21. The adjustment of the fuel injection amount is performed by the engine controller 22 controlling the fuel injection device 21. An actual rotation speed of the engine 11 is detected by a rotation speed sensor 23, and a detection signal is input into the engine controller 22 and the pump controller 24.

The main pump 10 is driven by the engine 11 to discharge hydraulic fluid. The main pump 10 includes a first hydraulic pump 12 and a second hydraulic pump 13. Hydraulic fluid discharged from the main pump 10 is supplied to the hydraulic cylinder 14 via the flowpath switching valve 16.

The first hydraulic pump 12 is a variable displacement hydraulic pump. The discharge flow rate of the first hydraulic pump 12 is controlled by controlling a tilt angle of the first hydraulic pump 12. The tilt angle of the first hydraulic pump 12 is controlled by a first pump-flow-rate control unit 25. The first pump-flow-rate control unit 25 controls the discharge flow rate of the first hydraulic pump 12 by controlling the tilt angle of the first hydraulic pump 12 on the basis of a command signal from the pump controller 24. The first hydraulic pump 12 is a two-directional discharge hydraulic pump. Specifically, the first hydraulic pump 12 has a first pump port 12*a* and a second pump port 12*b*. The first hydraulic pump 12 is switchable between a first discharge state and a second discharge state. The first hydraulic pump 12 sucks in hydraulic fluid from the second pump port 12*b* and discharges hydraulic fluid from the first pump port 12*a* in the first discharge state. The first hydraulic pump 12 sucks in hydraulic fluid from the first pump port 12*a* and discharges hydraulic fluid from the second pump port 12*b* in the second discharge state.

The second hydraulic pump 13 is a variable displacement hydraulic pump. The discharge flow rate of the second hydraulic pump 13 is controlled by controlling the tilt angle of the second hydraulic pump 13. The tilt angle of the second hydraulic pump 13 is controlled by a second pump-flow-rate control unit 26. The second pump-flow-rate control unit 26 controls the discharge flow rate of the second hydraulic pump 13 by controlling the tilt angle of the second hydraulic pump 13 on the basis of a command signal from the pump controller 24. The second hydraulic pump 13 is a two-directional discharge hydraulic pump. Specifically, the second hydraulic pump 13 has a first pump port 13*a* and a second pump port 13*b*. The second hydraulic pump 13 is switchable between a first discharge state and a second discharge state in the same way as the first hydraulic pump 12. The second hydraulic pump 13 sucks in hydraulic fluid from the second pump port 13*b* and discharges hydraulic fluid from the first pump port 13*a* in the first discharge state. The second hydraulic pump 12 sucks in hydraulic fluid from the first pump port 13*a* and discharges hydraulic fluid from the second pump port 13*b* in the second discharge state.

The hydraulic cylinder 14 is driven by hydraulic fluid discharged from the main pump 10. The hydraulic cylinder 14 drives working implements such as a boom, an arm, or a bucket. The hydraulic cylinder 14 includes a cylinder rod 14*a* and a cylinder tube 14*b*. The inside of the cylinder tube 14*b* is partitioned by the cylinder rod 14*a* into a first chamber 14*c* and a second chamber 14*d*. The hydraulic cylinder 14 has a first cylinder port 14*e* and a second cylinder port 14*f*. The first cylinder port 14*e* communicates with the first chamber 14*c*. The second cylinder port 14*f* communicates with the second chamber 14*d*. The hydraulic cylinder 14 is switchable between a state in which hydraulic fluid is supplied to the second cylinder port 14*f* and hydraulic fluid is exhausted from the first cylinder port 14*e*, and a state in which hydraulic fluid is supplied to the first cylinder port 14*e* and hydraulic fluid is exhausted from the second cylinder port 14*f*. The hydraulic cylinder 14 expands and contracts by switching between the supply and exhaust of hydraulic fluid to and from the first chamber 14*c* and the second chamber 14*d*. Specifically, the hydraulic cylinder 14 expands due to hydraulic fluid being supplied to the first chamber 14*c* via the first cylinder port 14*e*, and hydraulic fluid being exhausted from the second chamber 14*d* via the second cylinder port 14*f*. The hydraulic cylinder 14 contracts due to hydraulic fluid being supplied to the second chamber 14*d* via the second cylinder port 14*f*, and hydraulic fluid being exhausted from the first chamber 14*c* via the first cylinder port 14*e*. A pressure receiving area of the cylinder rod 14*a* in the first chamber 14*c* is greater than a pressure receiving area of the cylinder rod 14*a* in the second chamber 14*d*. Therefore, when the hydraulic cylinder 14 is expanded, more hydraulic fluid is supplied to the first chamber 14*c* than is exhausted from the second chamber 14*d*. When the hydraulic cylinder 14 is contracted, more hydraulic fluid is exhausted from the first chamber 14*c* than is supplied to the second chamber 14*d*.

The hydraulic fluid flowpath 15 connects the first hydraulic pump 12 and the second hydraulic pump 13 to the hydraulic cylinder 14. Specifically, the hydraulic fluid flowpath 15 includes a first flowpath 17 and a second flowpath 18. The first flowpath 17 connects the first pump port 12*a* of the first hydraulic pump 12 with the first cylinder port 14*e*. The first flowpath 17 connects the first pump port 13*a* of the second hydraulic pump 13 with the first cylinder port 14*e*. The second flowpath 18 connects a second pump port 12*b* of the first hydraulic pump 12 with the second cylinder port 14*f*. The first flowpath has a first cylinder flowpath 31 and a first pump flowpath 33. The second flowpath 18 has a second cylinder flowpath 32 and a second pump path 34. The first cylinder flowpath 31 is connected to the first chamber 14*c* of the hydraulic cylinder 14 via the first cylinder port 14*e*. The second cylinder flowpath 32 is connected to the second chamber 14*d* of the hydraulic cylinder 14 via the second cylinder port 14*f*. The first pump path 33 is a path for supplying hydraulic fluid to the first chamber 14*c* of the hydraulic cylinder 14 via the first cylinder path 31, or for recovering hydraulic fluid from the first chamber 14*c* of the hydraulic cylinder 14 via the first cylinder path 31. The first pump path 33 is connected to the first pump port 12*a* of the first hydraulic pump 12. The first pump path 33 is connected to the first pump port 13*a* of the second hydraulic pump 13. Therefore, hydraulic fluid is supplied to the first pump flowpath 33 from both the first hydraulic pump 12 and the second hydraulic pump 13. The second pump path 34 is a path for supplying hydraulic fluid to the second chamber 14*d* of the hydraulic cylinder 14 via the second cylinder path 32, or for recovering hydraulic fluid from the second chamber 14*d* of the hydraulic cylinder 14 via the second cylinder path 32. The second pump path 34 is connected to the second pump port 12*b* of the first hydraulic pump 12. The second pump port 13*b* of the second hydraulic pump 13 is connected to a hydraulic fluid tank 27. Therefore, hydraulic fluid is supplied to the second pump flowpath 34 from the first hydraulic pump 12. The hydraulic fluid flowpath 15 configures a closed circuit between the first hydraulic pump 12 and the hydraulic cylinder 14 with the first pump flowpath 33, the first cylinder flowpath 31, the second cylinder flowpath 32, and the second pump flowpath 34. The hydraulic fluid flowpath 15 configures an open circuit between the second hydraulic pump 13 and the hydraulic cylinder 14 with the first pump flowpath 33 and the first cylinder flowpath 31.

The hydraulic drive system 1 is further provided with a charge circuit 19. The charge circuit 19 has a charge flowpath 35 and a charge pump 28. The charge pump 28 is a hydraulic pump for replenishing the hydraulic fluid flowpath 15 with hydraulic fluid. The charge pump 28 is driven by the engine 11 to discharge hydraulic fluid to the charge flowpath 35. The charge pump 28 is a fixed displacement hydraulic pump. The charge path 35 connects the charge pump 28 with the hydraulic fluid flowpath 15. The charge flowpath 35 is connected between the main pump 10 and a first check valve 44 in the hydraulic fluid flowpath 15. Specifically, the charge path 35 is connected to the first pump flowpath 33 via a check valve 41*a*. The check valve 41*a* is open when the hydraulic pressure of the first pump flowpath 33 is lower than the charge pressure of the charge path 35. The charge flowpath 35 is connected between the main pump 10 and a second check valve 45 in the hydraulic fluid flowpath 15. Specifically, the charge path 35 is connected to the second pump flowpath 34 via a check valve 41*b*. The check valve 41*b* is open when the hydraulic pressure of the second pump path 34 is lower than the charge pressure. As a result, the charge circuit 19 replenishes the hydraulic fluid flowpath 15 with hydraulic fluid when the hydraulic pressure in the hydraulic fluid flowpath 15 is lower than the charge pressure. The charge flowpath 35 has a first charge flowpath 35*a* and a second charge flowpath 35*b*. The first charge flowpath 35*a* is connected to the charge pump 28. The second charge flowpath 35*b* is connected to the first charge flowpath 35*a* via a below mentioned third check valve 49. The second charge flowpath 35*b* is connected to the first pump path 33 via the abovementioned check valve 41*a*. The second charge flowpath 35*b* is connected to the second pump path 34 via the abovementioned check valve 41*b*. The charge path 35 is connected to the hydraulic fluid tank 27 via a charge relief valve 42. More specifically, the first charge flowpath 35*a* is connected to the hydraulic fluid tank 27 via the charge relief valve 42. The charge relief valve 42 maintains the charge pressure at a predetermined setting pressure. When the hydraulic pressure of the first pump flowpath 33 or the second pump flowpath 34 becomes lower than the charge pressure, hydraulic fluid from the charge pump 28 is supplied to the first pump flowpath 33 or the second pump flowpath 34 via the charge flowpath 35. As a result, the hydraulic pressures of the first pump flowpath 33 and the second pump flowpath 34 are maintained at a predetermined value or higher.

A discharge pressure reducing unit 39 is connected to the charge flowpath 35. More specifically, the discharge pressure reducing unit 39 is connected to the first charge flowpath 35*a*. The discharge pressure reducing unit 39 is a so-called bypass valve and is switchable between a connection state Pa and a closed state Pb. The discharge pressure reducing unit 39 connects the first charge flowpath 35*a* to the hydraulic fluid tank 27 in the connection state Pa. Therefore, the discharge pressure reducing unit 39 reduces the hydraulic pressure in the first charge flowpath 35*a* in the connection state Pa. Specifically, the discharge pressure reducing unit 39 reduces the discharge pressure of the charge pump 28 in the connection state Pa. The discharge pressure reducing unit 39 closes the connection between the first charge flowpath 35*a* and the hydraulic fluid tank 27 in the closed state Pb. The discharge pressure reducing unit 39 is a solenoid-operated control valve and is switched between the connection state Pa and the closed state Pb by a command signal from the pump controller 24. Specifically, the discharge pressure reducing unit 39 is set to the closed state Pb due to the biasing force of a biasing member 39*a* when the command signal from the pump controller 24 indicates OFF. The discharge pressure reducing unit 39 is set to the connection state Pa when the command signal from the pump controller 24 indicates ON.

The hydraulic fluid flowpath 15 further includes a relief flowpath 36. The relief flowpath 36 is connected to the first pump flowpath 33 via a check valve 41*c*. The check valve 41*c* is open when the hydraulic pressure of the first pump flowpath 33 is higher than the hydraulic pressure of the relief flowpath 36. The relief flowpath 36 is connected to the second pump flowpath 34 via a check valve 41*d*. The check valve 41*d* is open when the hydraulic pressure of the second pump flowpath 34 is higher than the hydraulic pressure of the relief flowpath 36. The relief flowpath 36 is connected to the charge flowpath 35 via a relief valve 43. The relief valve 43 maintains the pressure of the relief flowpath 36 at a pressure equal to or less than a predetermined relief pressure. As a result, the hydraulic pressure of the first pump flowpath 33 and the second pump flowpath 34 is maintained at a pressure equal to or less than the predetermined relief pressure. The hydraulic fluid flowpath 15 further includes an adjustment flowpath 37. The adjustment flowpath 37 is connected to the charge flowpath 35.

An accumulator 38 is connected to the charge flowpath 35. Specifically, the accumulator 38 is connected to the second charge flowpath 35*b*. The third check valve 49 is connected to the charge flowpath 35. The third check valve 49 is disposed between the first charge flowpath 35*a* and the second charge flowpath 35*b*. Specifically, the third check valve 49 is disposed between the accumulator 38 and the charge pump 28. The third check valve 49 allows a flow from the first charge flowpath 35*a* to the second charge flowpath 35*b* and prohibits a flow from the second charge flowpath 35*b* to the first charge flowpath 35*a*. Specifically, the check valve 39 allows the flow of hydraulic fluid from the charge pump 28 to the accumulator 38 and prohibits the flow of hydraulic fluid from the accumulator 38 to the charge pump 28 in the charge path 35. The third check valve 49 is an example of a one-way valve in the present invention. An accumulated pressure detecting unit 48 is connected to the accumulator 38. The accumulated pressure detecting unit 48 detects an accumulated pressure of the accumulator 38. The accumulated pressure detecting unit 48 sends a detection signal indicating the detected accumulated pressure to the pump controller 24.

The flowpath switching valve 16 is an electromagnetic control valve controlled on the basis of a command signal from the pump controller 24. The flowpath switching valve 16 switches flowpath connections on the basis of a command signal from the pump controller 24. The flowpath switching valve 16 is disposed between the main pump 10 and the hydraulic cylinder 14 in the hydraulic fluid flowpath 15. The flowpath switching valve 16 includes a first pump port 16*a*, a first cylinder port 16*b*, a first adjustment port 16*c*, and a first bypass port 16*d*. The first pump port 16*a* is connected to the first pump flowpath 33 via the first check valve 44. The first cylinder port 16*b* is connected to the first cylinder flowpath 31. The first adjustment port 16*c* is connected to the adjustment flowpath 37.

The first check valve 44 is disposed between the main pump 10 and the hydraulic cylinder 14 in the hydraulic fluid flowpath 15. The first check valve 44 allows the flow of hydraulic fluid from the main pump 10 to the hydraulic cylinder 14. The first check valve 44 prohibits the flow of hydraulic fluid from the hydraulic cylinder 14 to the main pump 10. Specifically, the first check valve 44 allows the flow of hydraulic fluid from the first pump flowpath 33 to the first cylinder flowpath 31 and prohibits the flow of hydraulic fluid from the first cylinder flowpath 31 to the first pump flowpath 33 when hydraulic fluid is supplied to the first cylinder flowpath 31 from the first pump flowpath 33 by the flowpath switching valve 16.

The flowpath switching valve 16 further includes a second pump port 16*e*, a second cylinder port 16*f*, a second adjustment port 16*g*, and a second bypass port 16*h*. The second pump port 16*e* is connected to the second pump flowpath 34 via a second check valve 45. The second check valve 45 is a check valve for restricting the flow of hydraulic fluid to one direction. The second cylinder port 16*f* is connected to the second cylinder flowpath 32. The second adjustment port 16*g* is connected to the adjustment flowpath 37.

The second check valve 45 is disposed between the main pump 10 and the hydraulic cylinder 14 in the hydraulic fluid flowpath 15. The second check valve 45 allows the flow of hydraulic fluid from the main pump 10 to the hydraulic cylinder 14. The second check valve 45 prohibits the flow of hydraulic fluid from the hydraulic cylinder 14 to the main pump 10. Specifically, the second check valve 45 allows the flow of hydraulic fluid from the second pump flowpath 34 to the second cylinder flowpath 32 and prohibits the flow of hydraulic fluid from the second cylinder flowpath 32 to the second pump flowpath 34 when hydraulic fluid is supplied to the second cylinder flowpath 32 from the second pump flowpath 34 by the flowpath switching valve 16.

The flowpath switching valve 16 is switchable between a first position state P1, a second position state P2, and a neutral position state Pn. The flowpath switching valve 16 allows communication between the first pump port 16*a* and the first cylinder port 16*b* and between the second cylinder port 16*f* and the second bypass port 16*h* in the first position state P1. Therefore, the flowpath switching valve 16 connects the first pump flowpath 33 to the first cylinder flowpath 34 via the first check valve 44 and connects the second cylinder flowpath 32 to the second pump flowpath 34 without passing through the second check valve 45 in the first position state P1. The first bypass port 16*d*, the first adjustment port 16*c*, the second pump port 16*e*, and the second adjustment port 16*g* are all cut off from communication with any port when the flowpath switching valve 16 is in the first position state P1.

When the hydraulic cylinder 14 is expanded, the first hydraulic pump 12 and the second hydraulic pump 13 are driven in the first discharge state and the flowpath switching valve 16 is set to the first position state P1. As a result, hydraulic fluid discharged from the first pump port 12*a* of the first hydraulic pump 12 and from the first pump port 13*a* of the second hydraulic pump 13 passes through the first pump path 33, the first check valve 44, and the first cylinder path 31 to be supplied to the first chamber 14*c* of the hydraulic cylinder 14. The hydraulic fluid in the second chamber 14*d* of the hydraulic cylinder 14 passes through the second cylinder path 32 and the second pump path 34 and is recovered in the second pump port 12*b* of the first hydraulic pump 12. As a result, the hydraulic cylinder 14 expands.

The flowpath switching valve 16 allows communication between the second pump port 16*e* and the second cylinder port 16*f* and between the first cylinder port 16*b* and the first bypass port 16*d* in the second position state P2. Therefore, the flowpath switching valve 16 connects the first cylinder flowpath 31 to the first pump flowpath 33 without passing through the first check valve 44 and connects the second pump flowpath 34 to the second cylinder flowpath 32 via the second check valve 45 in the second position state P2. The first pump port 16*a*, the first adjustment port 16*c*, the second bypass port 16*h*, and the second adjustment port 16*g* are all cut off from communication with any port when the flowpath switching valve 16 is in the second position state P2.

When the hydraulic cylinder 14 is contracted, the first hydraulic pump 12 and the second hydraulic pump 13 are driven in a second discharge state and the flowpath switching valve 16 is set to the second position state P2. As a result, hydraulic fluid discharged from the second pump port 12*b* of the first hydraulic pump 12 passes through the second pump flowpath 34, the second check valve 45, and the second cylinder flowpath 32 to be supplied to the second chamber 14*d* of the hydraulic cylinder 14. The hydraulic fluid in the first chamber 14*c* of the hydraulic cylinder 14 passes through the first cylinder path 31*a* and the first pump path 33 to be recovered in the first pump port 12*a* of the first hydraulic pump 12 and in the first pump port 13*a* of the second hydraulic pump 13. As a result, the hydraulic cylinder 14 contracts.

The flowpath switching valve 16 allows communication between the first bypass port 16*d* and the first adjustment port 16*c*, and between the second bypass port 16*h* and the second adjustment port 16*g* in the neutral position state Pn. Therefore, the flowpath switching valve 16 connects the first pump flowpath 33 to the adjustment flowpath 37 without passing through the first check valve 44, and connects the second pump flowpath 34 to the adjustment flowpath 37 without passing through the second check valve 45 in the neutral position state Pn. When the flowpath switching valve 16 is in the neutral position state Pn, the first pump port 16*a*, the first cylinder port 16*b*, the second pump port 16*e*, and the second cylinder port 16*f* are all cut off from communication with any port.

The hydraulic drive system 1 further includes an operating device 46. The operating device 46 includes an operating member 46*a* and an operation detecting unit 46*b*. The operating member 46*a* is operated by an operator to command various types of operations of the work machine. For example, when the hydraulic cylinder 14 is a boom cylinder for driving a boom, the operating member 46*a* is a boom operating lever for operating the boom. The operating member 46*a* may be operated in two directions: a direction for expanding the hydraulic cylinder 14 from the neutral position, and a direction for contracting the hydraulic cylinder 14 from the neutral position. The operation detecting unit 46*b* detects the operation amount and the operation direction of the operating member 46*a*. The operation detecting unit 46*b* is a sensor for detecting a position of the operating member 46*a*, for example. When the operating member 46*a* is positioned in the neutral position, the operation amount of the operating member 46*a* is zero. Detection signals that indicate the operation amount and the operation direction of the operating member 46*a* are input from the operation detecting unit 46*b* to the pump controller 24. The pump controller 24 calculates a target flow rate of the hydraulic fluid to be supplied to the hydraulic cylinder 14 in response to the operation amount of the operating member 46*a*.

The hydraulic drive system 1 further includes a display device 47. The display device 47 is, for example, a liquid crystal monitor display device. The display device 47 displays various types of information pertaining to the work machine in response to a command signal from the pump controller 24.

The engine controller 22 controls the output of the engine 11 by controlling the fuel injection device 21. Engine output torque characteristics determined on the basis of a set target engine rotation speed and a work mode are mapped and stored in the engine controller 22. The engine output torque characteristics indicate the relationship between the output torque and the rotation speed of the engine 11. The engine controller 22 controls the output of the engine 11 on the basis of the engine output torque characteristics.

The pump controller 24 controls the flow rate of hydraulic fluid to be supplied to the hydraulic cylinder 14 in response to the target flow rate set by the operating member 46*a*. When the hydraulic cylinder 14 is expanded, the pump controller 24 uses the first pump-flow-rate control unit 25 and the second pump-flow-rate control unit 26 to control the flow rate of hydraulic fluid to be supplied to the hydraulic cylinder 14. When the hydraulic cylinder 14 is contracted, the pump controller 24 uses the first pump-flow-rate control unit 25 to control the flow rate of the hydraulic fluid being supplied to the hydraulic cylinder 14.

The pump controller 24 controls the flowpath switching valve 16 in accordance with the operating direction of the operating member 46*a*. When the operating member 46*a* is operated in the direction for expanding the hydraulic cylinder 14 from the neutral position, the pump controller 24 sets the flowpath switching valve 16 to the first position state P1. As a result, the first pump flowpath 33 and the first cylinder flowpath 31 are connected via the first check valve 44. Furthermore, the second pump flowpath 34 and the second cylinder flowpath 32 are connected without passing through the second check valve 45. The hydraulic fluid is then discharged from the first pump port 12*a* of the first hydraulic pump 12 and from the first pump port 13*a* of the second hydraulic pump 13 to the first pump flowpath 33. However, the first check valve 44 does not open until the hydraulic pressure in the first pump flowpath 33 exceeds the holding pressure in the first cylinder flowpath 31 and the hydraulic cylinder 14 does not operate. Conversely, hydraulic fluid in the second pump path 34 is sucked into the second pump port 12*b* of the first hydraulic pump 12. As a result, the hydraulic pressure in the second pump flowpath 34 decreases. When the hydraulic pressure in the second pump flowpath 34 becomes equal to or less than the charge pressure, the check valve 41*b* opens to allow communication between the charge flowpath 35 and the second pump flowpath 34. As a result, the second pump flowpath 34 is replenished with hydraulic fluid from the charge flowpath 35. At this time, the second pump flowpath 34 is replenished, via the charge flowpath 35, with hydraulic fluid from the charge pump 28 and with hydraulic fluid from the accumulator 38 that was stored beforehand by the charge pump 28. When the hydraulic pressure in the first pump flowpath 33 exceeds the holding pressure of the first cylinder flowpath 31, the first check valve 44 opens and allows communication between the first pump flowpath 33 and the first cylinder flowpath 31. As a result, hydraulic fluid is supplied to the first chamber 14*c* of the hydraulic cylinder 14 and the hydraulic cylinder 14 expands. While the hydraulic cylinder 14 is expanding, hydraulic fluid is exhausted from the second chamber 14*d* of the hydraulic cylinder 14, passes through the second cylinder path 32 and the second pump path 34, and is returned to the second pump port 12*b* of the first hydraulic pump 12. At this time, the second pump flowpath 34 is replenished, from the charge flowpath 35, with hydraulic fluid at a flow rate required for compressing the hydraulic fluid in the first hydraulic pump 12, and hydraulic fluid at a flow rate sufficient to allow a leakage amount of hydraulic fluid in the first hydraulic pump 12 to be replenished.

When the operating member 46*a* is operated in the direction for contracting the hydraulic cylinder 14 from the neutral position, the pump controller 24 sets the flowpath switching valve 16 to the second position state P2. As a result, the second pump flowpath 34 and the second cylinder flowpath 32 are connected via the second check valve 45. Further, the first pump flowpath 33 and the first cylinder flowpath 31 are connected without passing through the first check valve 44. The hydraulic fluid is then discharged from the second pump port 12*b* of the first hydraulic pump 12 to the second pump flowpath 34. However, the second check valve 45 does not open until the hydraulic pressure in the second pump flowpath 34 exceeds the holding pressure in the second cylinder flowpath 32, and thus the hydraulic cylinder 14 does not operate. Conversely, hydraulic fluid in the first pump flowpath 33 is sucked into the first pump port 12 of the first hydraulic pump 12 and into the first pump port 13*a* of the second hydraulic pump 13. As a result, the hydraulic pressure in the first pump flowpath 33 decreases. When the hydraulic pressure in the first pump flowpath 33 becomes equal to or less than the charge pressure, the check valve 41*a* opens to allow communication between the charge flowpath 35 and the first pump flowpath 33. As a result, the first pump flowpath 33 is replenished with hydraulic fluid from the charge flowpath 35. At this time, the first pump flowpath 33 is replenished, via the charge flowpath 35, with hydraulic fluid from the charge pump 28 and with hydraulic fluid from the accumulator 38 that was stored beforehand by the charge pump 28. When the hydraulic pressure in the second pump flowpath 34 exceeds the holding pressure in the second cylinder flowpath 32, the second check valve 45 opens to allow communication between the second pump flowpath 34 and the second cylinder flowpath 32. As a result, hydraulic fluid is supplied to the second chamber 14*d* of the hydraulic cylinder 14, and thus the hydraulic cylinder 14 contracts. The hydraulic fluid is exhausted during a contraction of the hydraulic cylinder 14 from the first chamber 14*c* of the hydraulic cylinder 14, passes through the first cylinder path 31*a* and the first pump path 33, and is returned to the first pump port 12*a* of the first hydraulic pump 12 and to the first pump port 13*a* of the second hydraulic pump 13. At this time, the first pump flowpath 33 is replenished, from the charge flowpath 35, with hydraulic fluid at a flow rate required for compressing the hydraulic fluid in the first hydraulic pump 12, and hydraulic fluid at a flow rate sufficient to allow a leakage amount of hydraulic fluid in the first hydraulic pump 12 to be replenished.

Next, control of the discharge pressure of the charge pump 28 executed by the pump controller 24 will be described. The pump controller 24 has a pump control unit 24*a*, a memory unit 24*b*, an operating state determining unit 24*c*, a discharge pressure control unit 24*d*, and an accumulated pressure determining unit 24*e*. The pump control unit 24*a*, the operating state determining unit 24*c*, the discharge pressure control unit 24*d*, and the accumulated pressure determining unit 24*e* may be realized by a calculation device, such as a CPU and the like. The memory unit 24*b* may be realized by a recording device, such as a RAM, a ROM, a hard disk, or a flash memory and the like. The pump control unit 24*a* controls the discharge flow rate of the main pump 10 on the basis of an operating position of the operating member 46*a*. Specifically, the pump controller 24 calculates a target flow rate of the hydraulic fluid to be supplied to the hydraulic cylinder 14 in response to the operation amount of the operating member 46*a*. The memory unit 24*b* stores information for controlling the first hydraulic pump 12 and the second hydraulic pump 13.

Figure 2:
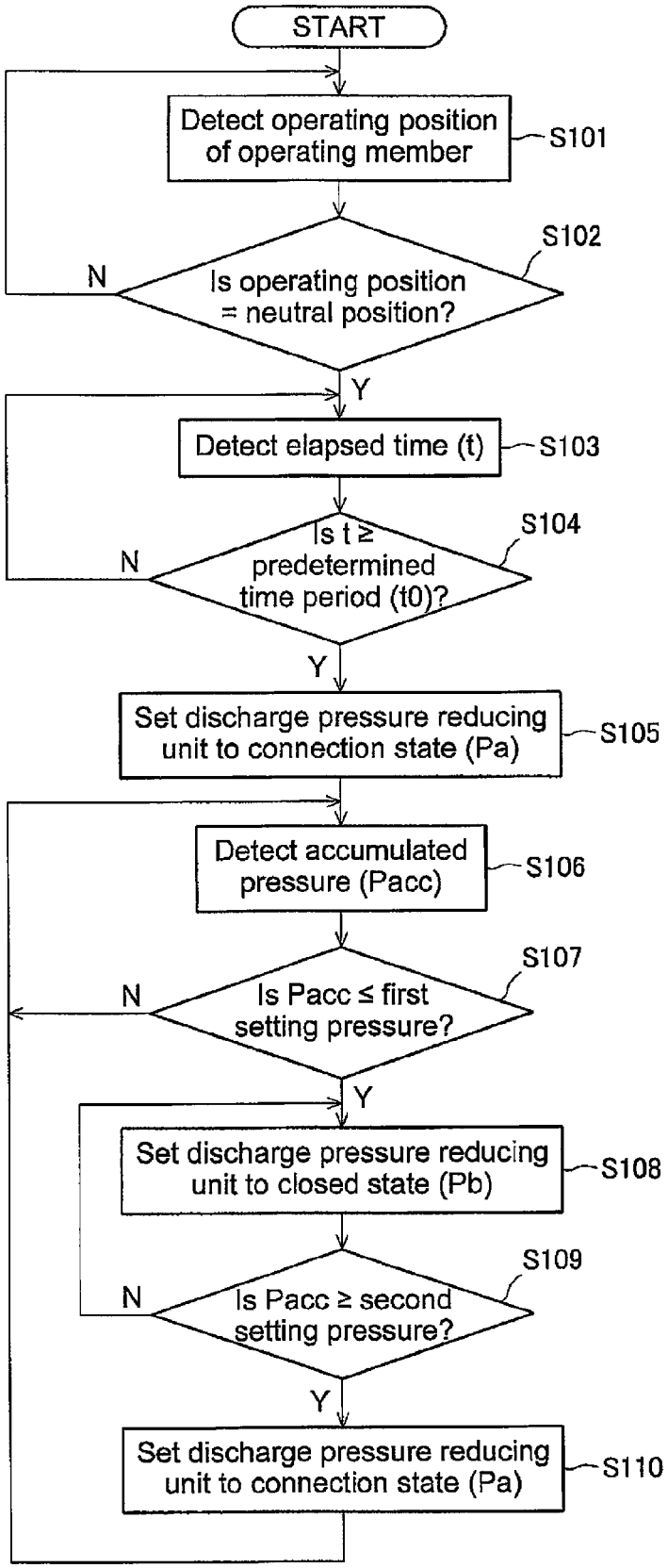
FIG. 2 is a flow chart illustrating processing for controlling a discharge pressure of a charge pump.

FIG. 2 is a flow chart illustrating processing for controlling the discharge pressure of the charge pump 28 executed by the pump controller 24. The control of the discharge pressure of the charge pump 28 is for controlling the discharge pressure of the charge pump 28 when the hydraulic cylinder 14 is not in operation. When the hydraulic cylinder 14 is in operation, the discharge pressure control unit 24*d* sets the discharge pressure reducing unit 39 to the closed state Pb by turning off a command signal to the discharge pressure reducing unit 39. As a result, the hydraulic pressure in the first charge flowpath 35*a* is regulated by the setting pressure of the charge relief valve 42. Specifically, the discharge pressure of the charge pump 28 is regulated by the setting pressure of the charge relief valve 42. Therefore, the discharge pressure (referred to below as "normal pressure") of the charge pump 28 when the hydraulic cylinder 14 is in operation corresponds to the setting pressure of the charge relief valve 42.

In step S101, the operation detecting unit 46*b* detects the operating position of the operating member 46*a*. In step S102, the operating state determining unit 24*c* determines whether the operating position is the neutral position. The routine advances to step S103 when the operating position is the neutral position. In step S103, the operating state determining unit 24*c* detects an elapsed time t. The elapsed time t is a time period from the point in time that the operating member 46*a* is switched to the neutral position to the current time. In step S104, the operating state determining unit 24*c* determines whether the elapsed time t is equal to or greater than a predetermined time to. The routine advances to step S105 when the elapsed time t is equal to or greater than the predetermined time t0. In this way, the operating state determining unit 24*c* determines in steps S101 to S104 whether the hydraulic cylinder 14 is in an operating state or a non-operating state on the basis of the detection signal from the operation detecting unit 46*b*. Specifically, the operating state determining unit 24*c* determines that the hydraulic cylinder 14 is in the non-operating state when the operating member 46*a* is held in the neutral position for a time period equal to or greater than the predetermined time t0. The operating state determining unit 24*c* determines that the hydraulic cylinder 14 is in operation when the holding time of the operating member 46*a* in the neutral position is less than the predetermined time t0. The operating state determining unit 24*c* determines that the hydraulic cylinder 14 is in operation when the operating member 46*a* is in a position other than the neutral position.

In step S105, the discharge pressure control unit 24*d* sets the discharge pressure reducing unit 39 to the connection state Pa. Specifically, the discharge pressure control unit 24*d* switches the discharge pressure reducing unit 39 from the closed state Pb to the connection state Pa by sending a command signal that indicates ON to the discharge pressure reducing unit 39. As a result, the discharge pressure of the charge pump 28 is reduced to a low pressure lower than the normal pressure.

In step S102, the routine returns to step S101 when the operating position is not the neutral position. In step S104, the routine returns to step S103 when the elapsed time t is less than the predetermined time t0. Specifically, when the operating state determining unit 24*c* determines that the hydraulic cylinder 14 is in operation, the discharge pressure control unit 24*d* maintains the discharge pressure reducing unit 39 in the closed state Pb. As a result, the discharge pressure of the charge pump 28 is maintained at the normal pressure while the hydraulic cylinder 14 is in operation.

In step S106, the accumulated pressure detecting unit 48 detects an accumulated pressure Pacc in the accumulator 38. In step S107, the accumulated pressure determining unit 24*e* determines whether the accumulated pressure Pacc is equal to or less than a first setting pressure. The first setting pressure corresponds to a lower limit of the accumulated pressure required in the accumulator 38. The routine advances to step S108 when the accumulated pressure Pacc is equal to or less than the first setting pressure.

In step S108, the discharge pressure control unit 24*d* sets the discharge pressure reducing unit 39 to the closed state Pb. As a result, hydraulic fluid to be discharged by the charge pump 28 is stored in the accumulator 38. Consequently, the discharge pressure of the charge pump 28 recovers from the low pressure to the normal pressure.

In step S109, the accumulated pressure determining unit 24*e* determines whether the accumulated pressure Pacc is equal to or greater than a second setting pressure. The second setting pressure is higher than the first setting pressure. The routine advances to step S109 when the accumulated pressure Pacc is equal to or greater than the second setting pressure.

In step S110, the discharge pressure control unit 24*d* sets the discharge pressure reducing unit 39 to the connection state Pa. As a result, the discharge pressure of the charge pump 28 is changed from the normal pressure to low pressure. Specifically, the discharge pressure control unit 24*d* returns the discharge pressure of the charge pump 28 from the normal pressure to the low pressure when the accumulated pressure of the accumulator 38 recovers from a pressure equal to or less than the first setting pressure to a pressure equal to or greater than the second setting pressure while the hydraulic cylinder 14 is not in operation.

When the accumulated pressure Pacc is not equal to or greater than the second setting pressure in step S109, the routine returns to step S108. As a result, the discharge pressure of the charge pump 28 is maintained at the normal pressure. Specifically, the discharge pressure control unit 24*d* maintains the discharge pressure of the charge pump 28 at the normal pressure until the accumulated pressure of the accumulator 38 recovers from a pressure equal to or less than the first setting pressure to a pressure equal to or greater than the second setting pressure.

Figure 3:
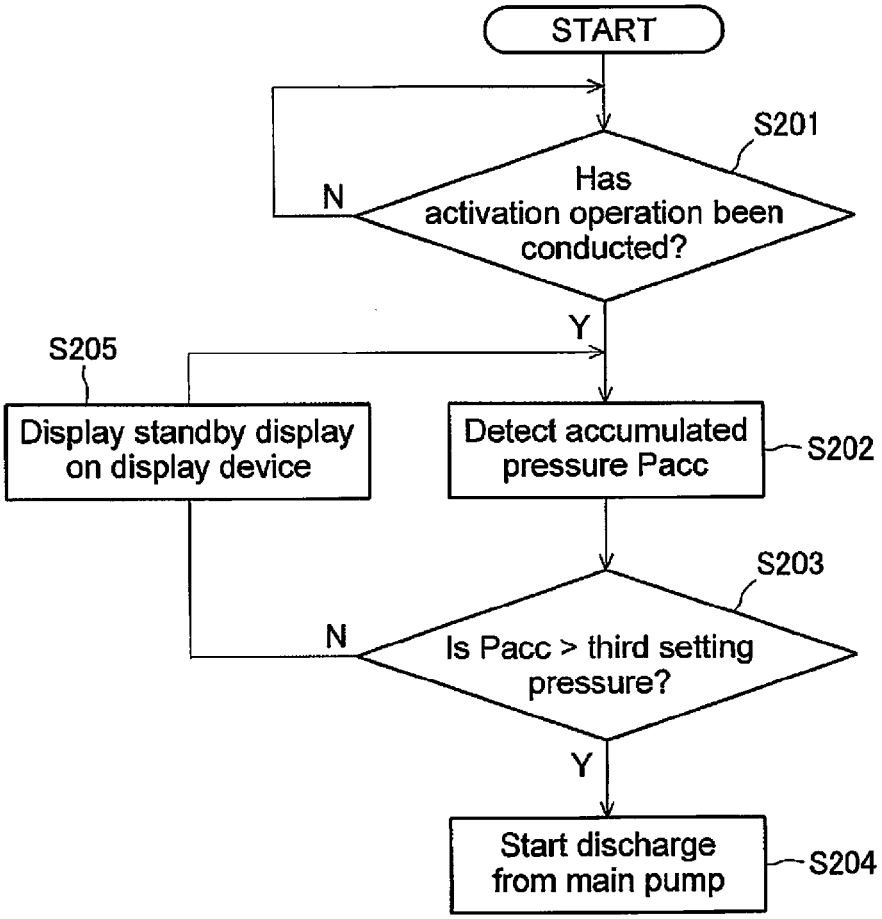
FIG. 3 is a flow chart illustrating processing for standby control.

FIG. 3 is a flow chart illustrating processing for standby control executed by the pump controller 24. The standby control is executed when an activation operation by the operating member 46*a* is detected. The activation operation is an operation for starting the discharge of hydraulic fluid from the main pump 10. In step S201, the operating state determining unit 24*c* determines whether an activation operation has been conducted. The operating state determining unit 24*c* determines whether the activation operation has been conducted on the basis of the operating position of the operating member 46*a*. For example, the operating state determining unit 24*c* determines that the activation operation has been conducted when an operation has been conducted for increasing the displacement of the main pump 10 from zero to a predetermined displacement. The routine advances to step S202 when the activation operation has been conducted.

In step S202, the accumulated pressure detecting unit 48 detects the accumulated pressure Pacc in the accumulator 38. In step S203, the accumulated pressure determining unit 24*e* determines whether the accumulated pressure Pacc is greater than a third setting pressure. The third setting pressure is equal to or higher than the first setting pressure. The third setting pressure may be the same as the first setting pressure. The routine advances to step S204 if the accumulated pressure Pacc is greater than the third setting pressure.

In step S204, the pump control unit 24*a* starts the discharge from the main pump 10. Specifically, the pump control unit 24*a* increases the displacements of the first hydraulic pump 12 and the second hydraulic pump 13 by controlling the first pump-flow-rate control unit 25 and the second pump-flow-rate control unit 26.

When the accumulated pressure Pacc is equal to or less than the third setting pressure in step S203, the pump control unit 24*a* causes the display device 47 to display a standby display in step S205. The standby display indicates that the standby control is being executed. Specifically, the standby display is used for notifying an operator that the discharge of the main pump 10 has not started due to the execution of the standby control.

As illustrated in steps S203 to S205, the pump control unit 24*a* does not start the discharge of hydraulic fluid from the main pump 10 until the accumulated pressure in the accumulator 38 is greater than the third setting pressure even if an activation operation is conducted by the operating member 46*a* when the accumulated pressure in the accumulator 38 is equal to or less than the third setting pressure.

The hydraulic drive system 1 according to the present exemplary embodiment has the following features.

The abovementioned control of the discharge pressure of the charge pump 28 allows for the reduction of the discharge pressure of the charge pump 28 to a low pressure when the hydraulic cylinder 14 is not in operation. As a result, power consumption loss of the charge pump 28 may be reduced. Moreover, when the pressure in the hydraulic fluid flowpath 15 between the main pump 10 and the check valves 44 and 45 is raised up to the holding pressure, the hydraulic fluid flowpath 15 may be replenished with hydraulic fluid discharged from the charge pump 28 and hydraulic fluid stored in the accumulator 38. As a result, the charge pump 28 may be made smaller in comparison to when the hydraulic fluid flowpath 15 is replenished with hydraulic fluid only from the charge pump 28. As a result, power consumption loss of the charge pump 28 may be reduced.

When the charge pump 28 is stopped, the flow of the hydraulic fluid stored in the accumulator 38 to the charge pump 28 is prohibited due to the third check valve 49. As a result, a reduction in the accumulated pressure of the accumulator may be suppressed.

The discharge pressure control unit 24*d* changes the discharge pressure of the charge pump 28 from low pressure to the normal pressure when the accumulated pressure of the accumulator 38 becomes equal to or less than the first setting pressure while the hydraulic cylinder 14 is not in operation. As a result, a reduction in the accumulated pressure of the accumulator may be suppressed even when the hydraulic cylinder 14 is maintained in a non-operating state for a long period of time. Specifically, the occurrence of aeration or of cavitation in the first hydraulic pump 12 may be suppressed when operation of the hydraulic cylinder is started.

The discharge pressure of the charge pump 28 is returned from the normal pressure to the low pressure when the accumulated pressure of the accumulator 38 recovers to be equal to or greater than the second setting pressure. As a result, power consumption loss of the charge pump 28 may be reduced.

The discharge of hydraulic fluid from the main pump 10 is not started until the accumulated pressure of the accumulator 38 exceeds the third setting pressure even when the activation operation is conducted by the operating member 46*a*. As a result, the occurrence of aeration or of cavitation in the first hydraulic pump 12 may be suppressed. The third setting pressure is equal to or higher than the first setting pressure. The discharge of hydraulic fluid from the main pump 10 may be started in a state in which a required amount of hydraulic fluid is stored in the accumulator 38.

The standby display is displayed on the display device 47 when the discharge of hydraulic fluid from the main pump 10 is stopped due to the standby control. As a result, the operator may be notified that the main pump 10 is not activated because the standby control is being executed.

The operating state determining unit 24*c* determines that the hydraulic cylinder 14 is in the non-operating state when the operating member 46*a* is held in the neutral position for a time equal to or greater than the predetermined time t0 during the discharge pressure control of the charge pump 28. As a result, the mistaken determination that the hydraulic cylinder 14 is not in operation when the hydraulic cylinder 14 is actually in operation when the operating member 46*a* temporarily passes through the neutral position, may be prevented.

Second Exemplary Embodiment

Figure 4:
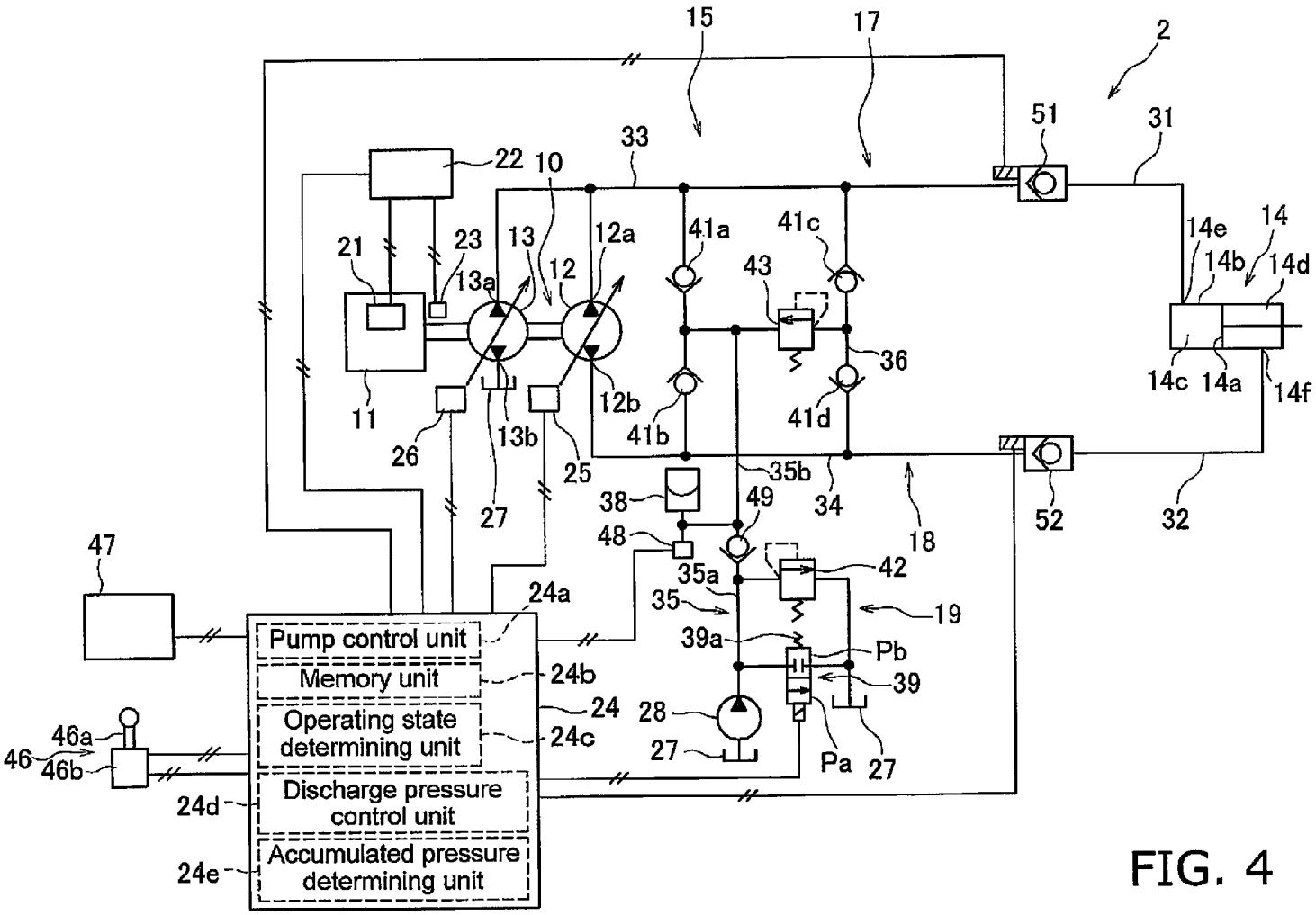
FIG. 4 is a block diagram of a configuration of a hydraulic drive system according to a second exemplary embodiment of the present invention.

Switching the direction of the flow of the hydraulic fluid to the hydraulic cylinder 14 is not limited to being conducted by the flowpath switching valve 16 of the first exemplary embodiment, and the switching may be conducted with another configuration. FIG. 4 is a block diagram of a configuration of a hydraulic drive system 2 according to a second exemplary embodiment of the present invention. A first pilot check valve 51 and a second pilot check valve 52 are used in the hydraulic drive system 2 in place of the flowpath switching valve 16 of the first exemplary embodiment. The first pilot check valve 51 is switched between a restricted state and an open state based on a command signal from the pump controller 24. The first pilot check valve 51 allows the flow of hydraulic fluid from the first pump flowpath 33 to the first cylinder flowpath 31 and prohibits the flow of hydraulic fluid from the first cylinder flowpath 31 to the first pump flowpath 33 in the restricted state. The first pilot check valve 51 allows the flow of hydraulic fluid from the first cylinder flowpath to the first pump flowpath in the open state. The second pilot check valve 52 is switched between the restricted state and the open state based on a command signal from the pump controller 24. The second pilot check valve 52 allows the flow of hydraulic fluid from the second pump flowpath 34 to the second cylinder flowpath 32 and prohibits the flow of hydraulic fluid from the second cylinder flowpath 32 to the second pump flowpath 34 in the restricted state. The second pilot check valve 52 allows the flow of hydraulic fluid from the second cylinder flowpath 32 to the second pump flowpath 34 in the open state.

When the operating member 46*a* is operated in the direction for expanding the hydraulic cylinder 14 from the neutral position, the pump controller 24 sets the first pilot check valve 51 to the restricted state and sets the second pilot check valve 52 to the open state. Therefore, if the hydraulic pressure in the first pump flowpath 33 exceeds the holding pressure in the first cylinder flowpath 31, the first pilot check valve 51 is opened and hydraulic fluid discharged from the first hydraulic pump 12 and from the second hydraulic pump 13 passes through the first pump flowpath 33 and the first cylinder flowpath 31 to be supplied to the first chamber 14*c* of the hydraulic cylinder 14. Hydraulic fluid is exhausted from the second chamber 14*d* of the hydraulic cylinder 14, passes through the second cylinder flowpath 32 and the second pump flowpath 34, and is returned to the first hydraulic pump 12.

When the operating member 46*a* is operated in the direction to contract the hydraulic cylinder 14 from the neutral position, the pump controller 24 sets the first pilot check valve 51 to the open state and sets the second pilot check valve 52 to the restricted state. Therefore, if the hydraulic pressure in the second pump flowpath 34 exceeds the holding pressure in the second cylinder flowpath 32, hydraulic fluid discharged from the first hydraulic pump 12 passes through the second pump flowpath 34 and the second cylinder flowpath 32 to be supplied to the second chamber 14*d* of the hydraulic cylinder 14. Hydraulic fluid is exhausted from the first chamber 14*c* of the hydraulic cylinder 14, passes through the first cylinder flowpath 31 and the first pump flowpath 33, and is returned to the first hydraulic pump 12 and to the second hydraulic pump 13.

Other control functions and configurations of the hydraulic drive system 2 are the same as those of the hydraulic drive system 1 in the first exemplary embodiment. The hydraulic drive system 2 of the second exemplary embodiment has the same features as the hydraulic drive system 1 of the first exemplary embodiment.

Although exemplary embodiments of the present invention have been described, the present invention is not limited to the above exemplary embodiments and various modifications may be made within the scope of the invention.

Figure 5:
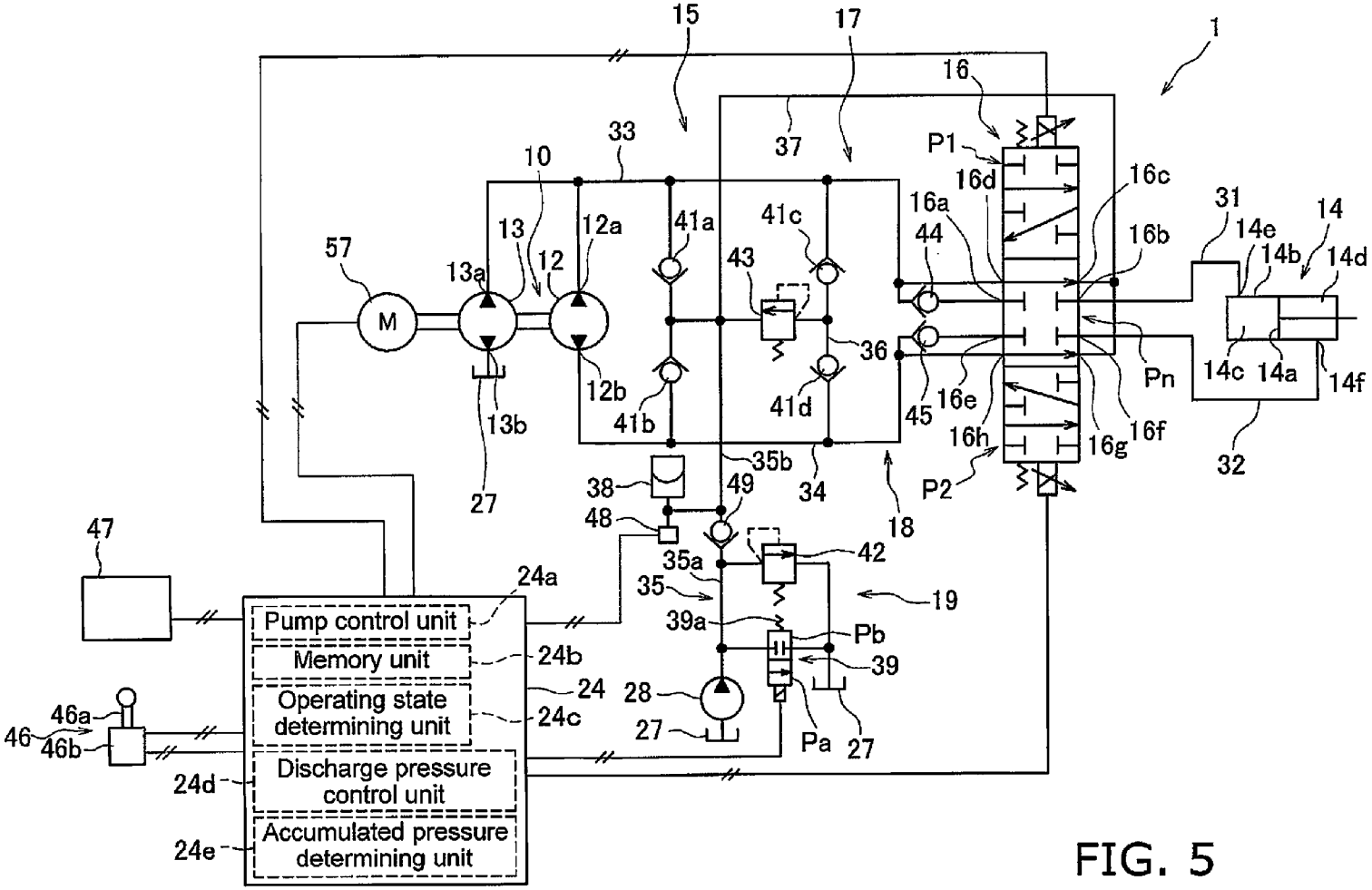
FIG. 5 is a block diagram of a configuration of a hydraulic drive system according to another exemplary embodiment of the present invention including an electric motor and a flowpath switching valve.
Figure 6:
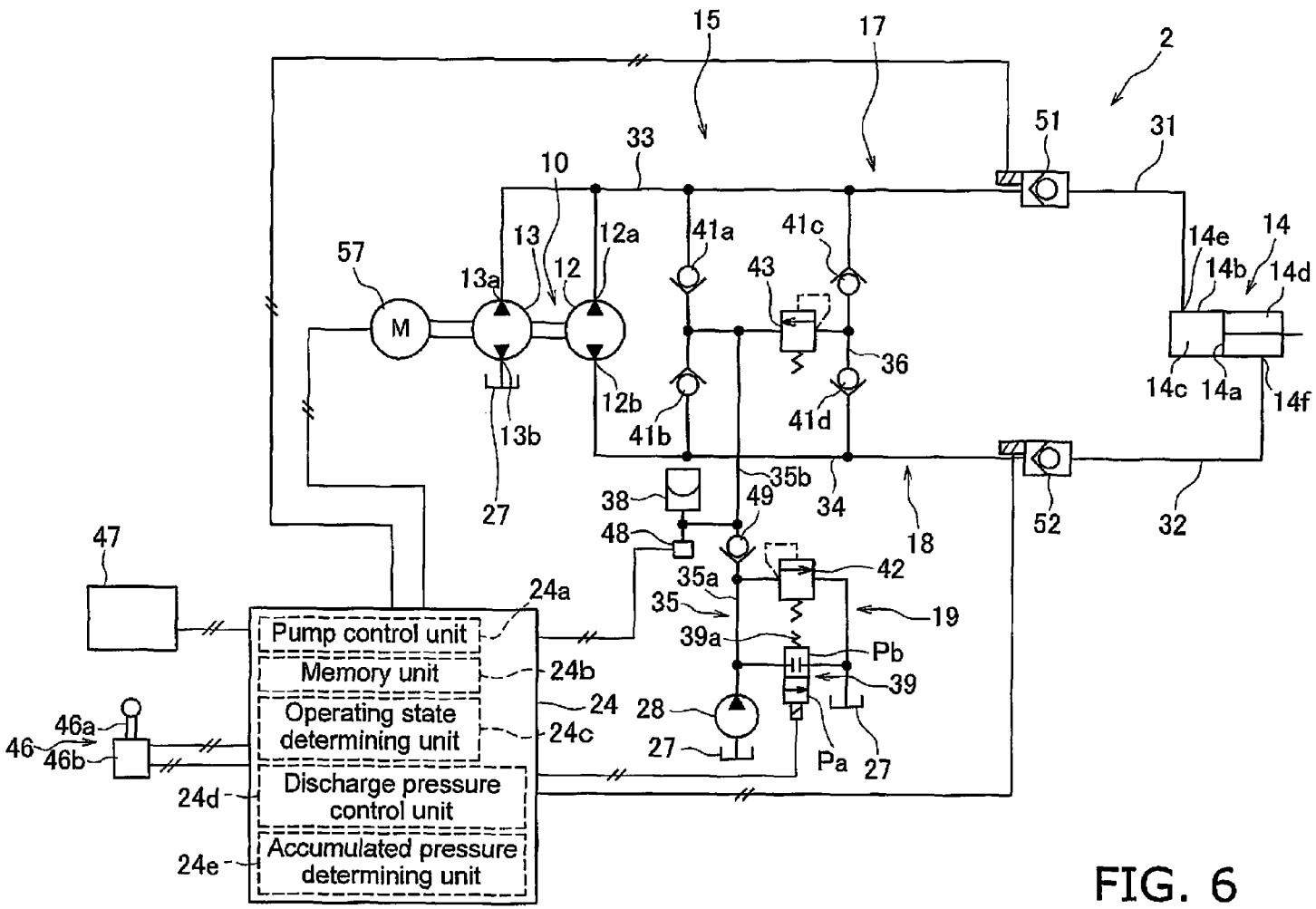
FIG. 6 is a block diagram of a configuration of a hydraulic drive system according to another exemplary embodiment of the present invention including an electric motor and pilot check valves.

The pump-flow-rate control units 25 and 26 in the above first exemplary embodiment and second exemplary embodiment control the discharge flow rate of the hydraulic pumps 12 and 13 by controlling the tilt angles of the hydraulic pumps 12 and 13. However, the discharge flow rates of the hydraulic pumps 12 and 13 may be controlled by controlling the rotation speeds of the hydraulic pumps 12 and 13. For example, an electric motor 57 may be used as a driving source as illustrated in FIG. 5. The electric motor 57 is used in place of the engine 11 from the hydraulic drive system 1 of the first exemplary embodiment in FIG. 5. The hydraulic pumps 12 and 13 are fixed displacement hydraulic pumps. In this case, the pump controller 24 controls the rotation speeds of the hydraulic pumps 12 and 13 so that the discharge flow rates of the hydraulic pumps 12 and 13 match a target flow rate corresponding to the operation amount of the operating member 46*a* by controlling the rotation speed of the electric motor 57. Alternatively, the electric motor 57 may be used as a driving source in place of the engine 11 in the hydraulic drive system 2 of the second exemplary embodiment as illustrated in FIG. 6. When the electric motor 57 is used as the driving source, the activation operation during the standby control may be an operation to increase the rotation speeds of the hydraulic pumps 12 and 13 from zero to a predetermined rotation speed.

In the above exemplary embodiments, the discharge pressure reducing unit 39 is set to the closed state Pb when the command signal from the pump controller 24 indicates OFF. The discharge pressure reducing unit 39 is set to the connection state Pa when the command signal from the pump controller 24 indicates ON. However, in contrast to the above explanation, the discharge pressure reducing unit 39 may be set to the connection state Pa due to the biasing force of a biasing member 39*a* when the command signal from the pump controller 24 indicates OFF. The discharge pressure reducing unit 39 may be set to the closed state Pb by a solenoid thrust force when the command signal from the pump controller 24 indicates ON.

The discharge pressure reducing unit is not limited to a bypass valve and may be a device that enable to reduce the discharge pressure of the charge pump 28 to a pressure lower than a setting pressure of the charge relief valve 42. For example, the charge relief valve 42 may be used as a discharge pressure reducing unit. In this case, the relief pressure of the charge relief valve 42 is switched between a first relief pressure and a second relief pressure. The first relief pressure corresponds to the abovementioned normal pressure. The second relief pressure corresponds to the abovementioned low pressure. The charge relief valve 42 reduces the discharge pressure of the charge pump 28 by switching the relief pressure from the first relief pressure to the second relief pressure on the basis of a command signal from the pump controller 24.

A one-way valve other than a check valve may be used in place of the third check valve 49. The display device 47 is not limited to a screen device and another display device, such as a warning light, may be used. The determination of whether the hydraulic cylinder 14 is in operation or is not in operation is not limited to the operation of the operating member 46*a* and another method may be used for the determination. For example, the determination of whether the hydraulic cylinder 14 is in operation or is not in operation may be conducted by detecting the operation of the hydraulic cylinder 14. However, the operating state determining unit 24*c* preferably conducts the determination on the basis of the operation of the operating member 46*a* due to the execution of the abovementioned standby control.

According to the present invention, a hydraulic drive system that is able to reduce power consumption loss in the charge pump may be provided.

What is claimed is:

1. A hydraulic system, comprising:

a main pump having a first hydraulic pump and a second hydraulic pump configured to discharge hydraulic fluid;

a hydraulic cylinder driven by hydraulic fluid discharged from the main pump;

a hydraulic fluid flowpath connecting the first hydraulic pump and the second hydraulic pump to the hydraulic cylinder, the hydraulic fluid flowpath composing a closed circuit between the first hydraulic pump and the hydraulic cylinder;

a check valve disposed in the hydraulic fluid flowpath between the main pump and the hydraulic cylinder, the check valve being configured to allow a flow of hydraulic fluid from the main pump to the hydraulic cylinder and prohibit a flow of hydraulic fluid from the hydraulic cylinder to the main pump;

a charge circuit having a charge flowpath connected to a position between the main pump and the check valve in the hydraulic fluid flowpath, and a charge pump configured to discharge hydraulic fluid to the charge flowpath, the charge circuit being configured to replenish the hydraulic fluid flowpath with hydraulic fluid when an hydraulic pressure of the hydraulic fluid flowpath is lower than a hydraulic pressure of the charge flowpath;

an operating member configured to operate the hydraulic cylinder;

an operating state determining unit configured to determine whether the hydraulic cylinder is in operation or not in operation;

a discharge pressure reducing unit configured to reduce the discharge pressure of the charge pump;

a discharge pressure control unit configured to control the discharge pressure reducing unit while the hydraulic cylinder in not in operation and to reduce the discharge pressure of the charge pump to a low pressure lower than a normal pressure that is the discharge pressure of the charge pump when the hydraulic cylinder is in operation;

an accumulator connected to the charge flowpath;

a one-way valve disposed between the accumulator and the charge pump, the one-way valve being configured to allow a flow of hydraulic fluid from the charge pump to the accumulator and prohibit a flow of hydraulic fluid from the accumulator to the charge pump;

an accumulated pressure detecting unit configured to detect an accumulated pressure of the accumulator; and an accumulated pressure determining unit configured to determine whether the accumulated pressure of the accumulator is equal to or less than a first setting pressure, the discharge pressure control unit being configured to change the discharge pressure of the charge pump from the low pressure to the normal pressure when the accumulated pressure of the accumulator is equal to or less than the first setting pressure while the hydraulic cylinder is not in operation.

2. The hydraulic drive system according to claim 1, wherein the accumulated pressure determining unit determines whether the accumulated pressure of the accumulator is equal to or greater than a second setting pressure that is greater than the first setting pressure; and the discharge pressure control unit returns the discharge pressure of the charge pump from the normal pressure to the low pressure when the accumulated pressure of the accumulator recovers from a pressure equal to or less than the first setting pressure to a pressure equal to or greater than the second setting pressure while the hydraulic cylinder is not in operation.

3. The hydraulic drive system according to claim 1, further comprising a pump control unit configured to control a discharge flow rate of the main pump on the basis of an operating position of the operating member; wherein the operating state determining unit determines whether the hydraulic cylinder is in operation or not in operation on the basis of the operating position of the operating member;

the accumulated pressure determining unit determines whether the accumulated pressure of the accumulator is equal to or less than a third setting pressure; and the pump control unit conducts a standby control that prevents the start of a discharge of hydraulic fluid from the main pump until the accumulated pressure of the accumulator exceeds the third setting pressure even when an operation to start a discharge of hydraulic fluid from the main pump is conducted due to the operating member when the accumulated pressure of the accumulator is equal to or less than the third setting pressure.

4. The hydraulic drive system according to claim 3, wherein the third setting pressure is a pressure equal to or greater than the first setting pressure.

5. The hydraulic drive system according to claim 3, further comprising a display device configured to display that the standby control is being executed.

6. The hydraulic drive system according to claim 1, wherein the operating state determining unit determines that the hydraulic cylinder is not in operation when the operating member is held in the neutral position for a time period equal to or greater than a predetermined time period.

7. The hydraulic drive system according to claim 1, wherein the charge flowpath has a first charge flowpath connected to the charge pump, and a second charge flowpath connected to the first charge flowpath via the one-way valve; and the discharge pressure reducing unit reduces the hydraulic pressure of the first charge flowpath.

8. The hydraulic drive system according to claim 2, further comprising a pump control unit configured to control a discharge flow rate of the main pump on the basis of an operating position of the operating member; wherein the operating state determining unit determines whether the hydraulic cylinder is in operation or not in operation on the basis of the operating position of the operating member;

the accumulated pressure determining unit determines whether the accumulated pressure of the accumulator is equal to or less than a third setting pressure; and the pump control unit conducts a standby control that prevents the start of a discharge of hydraulic fluid from the main pump until the accumulated pressure of the accumulator exceeds the third setting pressure even when an operation to start a discharge of hydraulic fluid from the main pump is conducted due to the operating member when the accumulated pressure of the accumulator is equal to or less than the third setting pressure.

* * * * *